US005401539A

United States Patent [19]

Coombs et al.

[11] Patent Number: 5,401,539

[45] Date of Patent: * Mar. 28, 1995

[54] PRODUCTION OF METAL SPRAY DEPOSITS

[75] Inventors: Jeffrey Coombs, West Glamorgan; Alan Leatham, Swansea, both of United Kingdom

[73] Assignee: Osprey Metals Limited, West Glamorgan, United Kingdom

[ * ] Notice: The portion of the term of this patent subsequent to May 5, 2009 has been disclaimed.

[21] Appl. No.: 55,771

[22] Filed: May 3, 1993

Related U.S. Application Data

[63] Continuation of Ser. No. 877,195, May 1, 1992, abandoned, which is a continuation of Ser. No. 612,512, Sep. 20, 1990, Pat. No. 5,110,631, which is a continuation of Ser. No. 323,158, Mar. 15, 1989, abandoned, which is a continuation of Ser. No. 83,788, Jul. 1, 1987, abandoned.

[30] Foreign Application Priority Data

Nov. 12, 1985 [GB] United Kingdom ..... 852783
Nov. 12, 1985 [GB] United Kingdom ..... 8527854

[51] Int. Cl.[6] ..... B05D 1/02

[52] U.S. Cl. ..... 427/422; 427/425; 427/427

[58] Field of Search ..... 427/422, 425, 427, 455, 427/456; 118/321

[56] References Cited

U.S. PATENT DOCUMENTS

| | | | |
|---|---|---|---|
| 3,019,014 | 1/1962 | Miksis | 427/425 |
| 4,064,295 | 12/1977 | Singer | 427/421 |
| 4,099,481 | 7/1978 | Lyons | 427/423 |
| 4,302,483 | 11/1981 | Altorfer et al. | 427/423 |
| 5,110,631 | 5/1992 | Leatham et al. | 427/422 |

FOREIGN PATENT DOCUMENTS

| | | |
|---|---|---|
| 2043882 | 2/1974 | Germany . |
| 1379261 | 1/1975 | United Kingdom . |
| 1472939 | 5/1977 | United Kingdom . |
| 1599392 | 9/1981 | United Kingdom . |

*Primary Examiner*—Shrive Beck
*Assistant Examiner*—Katherine A. Bareford
*Attorney, Agent, or Firm*—Roylance, Abrams, Berdo & Goodman

[57] ABSTRACT

A method of forming a deposit in which a spray of gas atomized molten metal or metal alloy is generated and directed at a substrate. The substrate is rotated about an axis of rotation and a controlled amount of heat is extracted from the molten metal or metal alloy in flight and/or on deposition. The spray is oscillated relative to the substrate, preferably along the axis of the substrate. With continuous production techniques involving a single pass, base porosity can be considerably reduced and in the formation of thicker deposits of discrete length, base porosity can be minimized and reciprocation lines can be eliminated or reduced in intensity.

13 Claims, 6 Drawing Sheets

SPRAY DEPOSITED

STATIONARY SPRAY 100 μ
IN625 ON MILD STEEL FORMER

OSCILLATING ATOMISER 100 μ
IN625 ON MILD STEEL FORMER

PRODUCTION OF METAL SPRAY DEPOSITS

This is a continuation of application Ser. No. 07/877,195, filed May 1, 1992, now abandoned, which is a continuation of application Ser. No. 07/612,512, filed Sep. 20, 1990, now U.S. Pat. No. 5,110,631; which is a continuation of application Ser. No. 07/323,158, filed Mar. 15, 1989, now abandoned; which is a continuation of application Ser. No. 07/083,788, filed Jul. 1, 1987, now abandoned, which was a national stage application of PCT/GB86/00698 filed Nov. 12, 1986.

This invention relates to the production of metal or metal alloy spray deposits using an oscillating spray for forming products such as tubes of semi-continuous or continuous length or for producing tubular, roll, ring, cone or other axi-symmetric shaped deposits of discrete length. The invention also relates to the production of coated products.

Description of the Related Art Including Information Disclosed Under 37 C.F.R. §1.97–1.99

Methods and apparatus are known (our UK Patent Nos: 1379261, 1472939 and 1599392) for manufacturing spray-deposited shapes of metal or metal alloy. In these known methods a stream of molten metal, or metal alloy, which teems from a hole in the base of a tundish, is atomised by means of high velocity jets of relatively cold gas and the resultant spray of atomised particles is directed onto a substrate or collecting surface to form a coherent deposit. In these prior methods it is also disclosed that by extracting a controlled amount of heat from the atomised particles in flight and on deposition, it is possible to produce a spray-deposit which is non-particulate in nature, over 95% dense and possesses a substantially uniformly distributed, closed to atmosphere pore structure.

At present products, such as tubes for example are produced by the gas atomization of a stream of molten metal and by directing the resultant spray onto a rotating, tubular shaped substrate. The rotating substrate can either traverse slowly through the spray to produce a long tube in a single pass or may reciprocate under the spray along its axis of rotation (as disclosed in our UK Patent No: 1599392) to produce a tubular deposit of a discrete length. By means of the first method (termed the single pass technique) the metal is deposited in one pass only. In the second method (termed the reciprocation technique) the metal is deposited in a series of layers which relate to the number of reciprocations under the spray of atomised metal. In both these prior methods the spray is of fixed shape and is fixed in position (i.e. the mass flux density distribution of particles is effectively constant with respect to time) and this can result in problems with respect to both production rate and also metallurgical quality in the resulting spray deposits.

These problems with regard to the single pass technique are best understood by referring to FIG. 1 and FIG. 2. The shape of a spray of atomised molten metal and the mass distribution of metal particles in the spray are mainly a function of the type and specific design of the atomiser used and the gas pressure under which it operates. Typically, however, a spray is conical in shape with a high density of particles in the center i.e. towards the mean axis of the spray X and a low density at its periphery. The "deposition profile" of the deposit D which is produced on a tubular-shaped substrate 1 which is rotating only under this type of spray is shown in FIG. 1(*a*). It can be seen that the thickness of the resulting deposit D (and consequently the rate of metal deposition) varies considerably from a position corresponding to the central axis X of the spray to its edge. FIG. 1(*b*) shows a section through a tubular spray deposit D formed by traversing a rotating tubular-shaped collector 1 through the same spray as in FIG. 1(*a*) in a single pass in the direction of the arrow to produce a tube of relatively long length. Such a method has several major disadvantages. For example, the inner and outer surface of the spray-deposited tube are formed from particles at the edge of the spray which are deposited at relatively low rates of deposition. A low rate of deposition allows the already deposited metal to cool excessively as the relatively cold atomising gas flows over the deposition surface. Consequently, subsequently arriving particles do not "bond" effectively with the already deposited metal resulting in porous layers of interconnected porosity at the inner and outer surfaces of the deposit. This interconnected porosity which connects to the surface of the deposit can suffer internal oxidation on removal of the deposit from the protective atmosphere inside the spray chamber. In total these porous layers can account for up to 15% of the total deposit thickness. The machining off of these porous layers can adversely affect the economics of the spray deposition process. The central portion of the deposit is formed at much higher rates of particle deposition with much smaller time intervals between the deposition of successive particles. Consequently, the deposition surface is cooled less and the density of the deposit is increased, any porosity that does exist is in the form of isolated pores and is not interconnected.

The maximum overall rate of metal deposition (i.e. production rate) that can be achieved (for a given atomiser and atomising gas consumption) in the single pass technique is related to the maximum rate of deposition at the centre of the spray. If this exceeds a certain critical level insufficient heat is extracted by the atomising gas from the particles in flight and on deposition, resulting in an excessively high liquid metal content at the surface of the already deposited metal. If this occurs the liquid metal is deformed by the atomising gas as it impinges on the deposition surface and can also be ejected from the surface of the preform by the centrifugal force generated from the rotation of the collector. Furthermore, casting type detects (e.g. shrinkage porosity, not tearing, etc.) can occur in the deposit.

A further problem with the single pass technique of the prior art is that the deposition surface has a low angle of inclination relative to the direction of the impinging particles (as shown in FIG. 1(*b*)) i.e. the particles impinge the deposition surface at an oblique angle. Such a low impingement angle is not desirable and can lead to porosity in the spray deposit. This is caused by the top parts of the deposition surface acting as a screen or a barrier preventing particles from being deposited lower down. As the deposit increases in thickness particularly as the angle of impingement becomes less than 45 degrees, the problem becomes progressively worse. This phenomenon is well known from conventional metallising theory where an angle of impingement of particles relative to the deposition surface of less than 45 degrees is very undesirable and can result in porous zones in the spray deposit. Consequently, using the single pass technique there is a limit on the thickness of deposit that can be successfully produced. Typically, this is approximately 50 mm wall thickness for a tubular shaped deposit.

The three major problems associated with the single pass technique; namely, surface porosity, limited metal deposition rate and limited wall thickness can be partly overcome by using the reciprocation technique where the metal is deposited in a series of layers by traversing the rotating collector backwards and forwards under the spray. However, where reciprocation movements are required there is a practical limit to the speed of movement particularly with large tubular shaped deposits (e.g. 500 kg) due to the deceleration and acceleration forces generated at the end of each reciprocation stroke. There is also a limit to the length of tube that can be produced as a result of an increasing time interval (and therefore increased cooling of the deposited metal) between the deposition of each successive layer of metal with increasing tube length. Moreover, the microstructure of the spray deposit often exhibits "reciprocation bands or lines" which correspond to each reciprocation pass under the spray. Depending on the conditions of deposition the reciprocation bands can consist of fine porosity and/or microstructural variations in the sprayed deposit corresponding to the boundary of two successively deposited layers of metal; i.e. where the already deposited metal has cooled excessively mainly by the atomising gas flowing over its surface prior to returning to the spray on the next reciprocation of the substrate. Typically the reciprocation cycle would be of the order of 1–10 seconds depending on the size of the spray-deposited article.

The problems associated with both the single pass technique and the reciprocation technique can be substantially overcome by utilising the present invention.

SUMMARY OF THE INVENTION

According to the present invention there is provided a method of forming a deposit on the surface of a substrate comprising the steps of;

generating a spray of gas atomised molten metal, metal alloy or molten ceramic particles which are directed at the substrate, rotating the substrate about an axis of the substrate, extracting heat in flight and/or on deposition from the atomised particles to produce a coherent deposit, and oscillating the spray so that the spray is moved over at least a part of the surface of the substrate.

The atomising gas is typically an inert gas such as Nitrogen, Oxygen or Helium. Other gases, however, can also be used including mixed gases which may contain Hydrogen, Carbon Dioxide, Carbon Monoxide or Oxygen. The atomising gas is normally relatively cold compared to the stream of liquid metal.

DESCRIPTION OF THE PREFERRED EMBODIMENTS

Figure 1A:
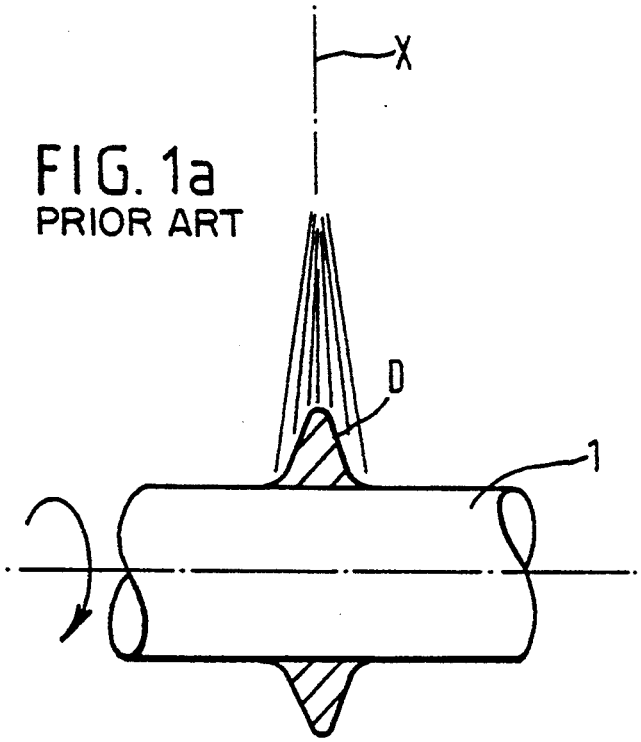
FIG. 1a PRIOR ART
FIG. 1*a* is a sectional view of the deposition profile of a deposit produced on a tubular substrate that is rotating only under a stationary (prior art) spray.
Figure 1B:
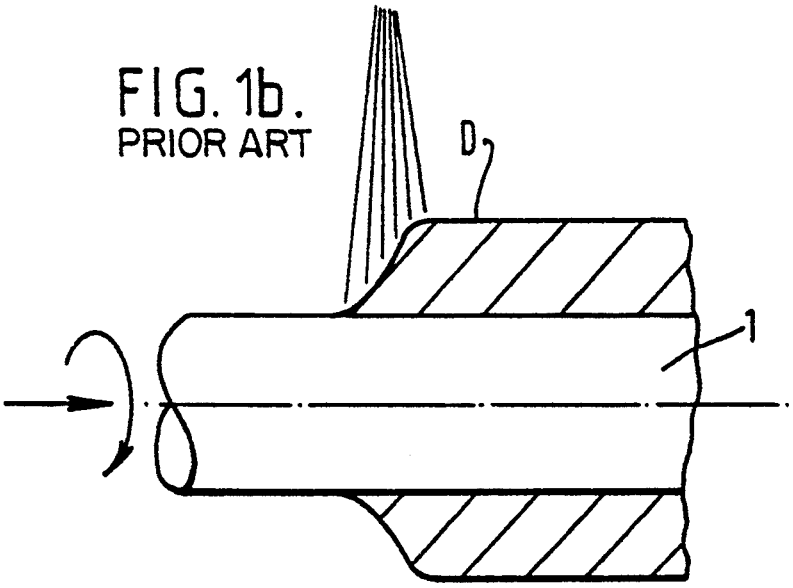
FIG. 1b. PRIOR ART
FIG. 1*b* shows a section through a tubular spray deposit formed by traversing a rotating tubular-shaped collector through a stationary (prior art) spray.
Figure 2A:
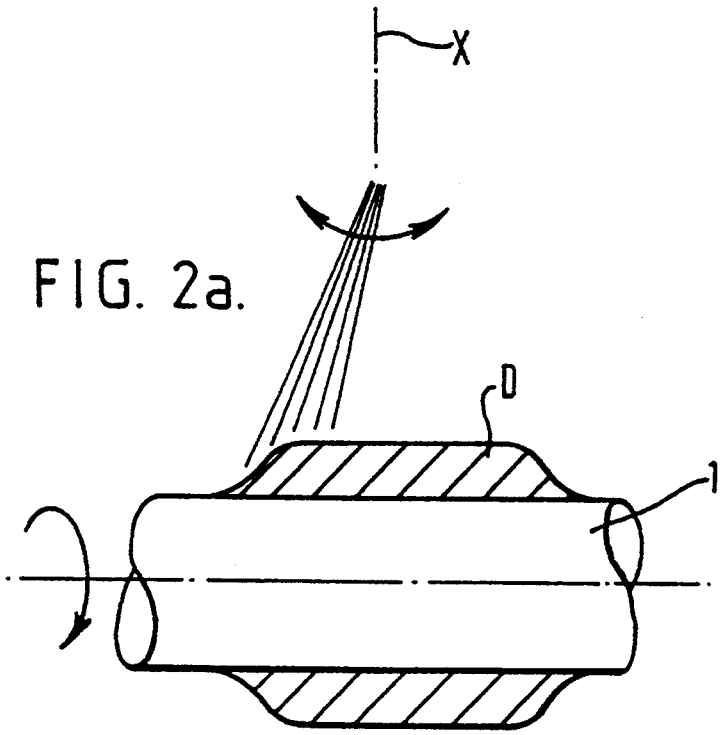
FIG. 2*a* is a sectional view of the depositional profile of the deposit produced on a tubular substrate that is rotating only under an oscillating spray in accordance with the present invention.
Figure 2B:
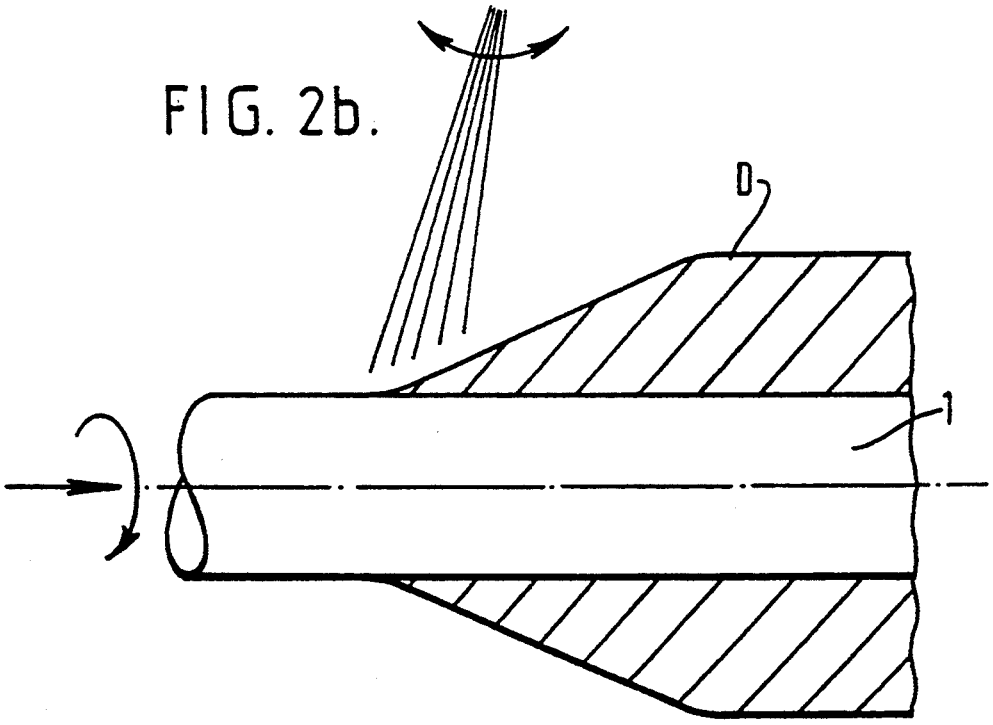
FIG. 2*b* shows a section through a tubular spray deposit formed by traversing a rotating tubular-shaped collector through an oscillating spray in accordance with the present invention.

The present invention is particularly applicable to the continuous production of tubes, or coated tubes or coated bar and in this arrangement the substrate is in the form of a tube or solid bar which is rotated and traversed in an axial direction in a single pass under the oscillating spray. In this arrangement the oscillation, in the direction of movement of the substrate has several important advantages over the existing method using a fixed spray. These can be explained by reference to FIGS. 2(*a*) and 2(*b*). The "deposition profile" of the deposit which is produced on a tubular shaped collector which is rotating only under the oscillating spray is shown in FIGS. 2(*a*). By comparing with FIG. 1(*a*) which is produced from a fixed spray (of the same basic shape as the oscillating spray) it can be seen that the action of oscillating the spray has produced a deposit which is more uniform in thickness. FIG. 2(*b*) shows a section through a tubular sprayed deposit formed by traversing in a single pass a rotating tubular shaped collector through the oscillating spray. The advantages of an oscillating spray are apparent and are as follows (compare FIGS. 1 and 2):

(i) Assuming that there is no variation in the speed of movement of the spray within each oscillation cycle the majority of metal will be deposited at the same rate of deposition and therefore the conditions of deposition are relatively uniform. The maximum rate of metal deposition is also lower when compared to the fixed spray of FIG. 1(*a*) which means that the overall deposition rate can be increased without the deposition surface becoming excessively hot (or containing an excessively high liquid content).

(ii) The percentage of metal at the leading and trailing edges of the spray which is deposited at a low rate of deposition is markedly reduced and therefore the amount of interconnected porosity at the inner and outer surface of the spray deposited tube is markedly reduced or eliminated altogether.

(iii) For a given deposit thickness the angle of impingement of the depositing particles relative to the deposition surface is considerably higher. Consequently much thicker deposits can be successfully produced using an oscillating spray.

It should be noted that simply by increasing the amplitude of oscillation of the spray (within limits e.g. included angles of oscillation up to 90° can be used) the angle of impingement of the particles at the deposition surface can be favourably influenced and therefore thicker deposits can be produced. In addition, for a given deposit, an increased amplitude also allows deposition rates to be increased, (or gas consumption to be decreased). Therefore, the economics and the production output of the spray deposition process can be increased.

The present invention is also applicable to the production of a sprayed deposit of discrete length where there is no axial movement of the substrate, i.e. the substrate rotates only. A "discrete length deposit" is typically a single product of relatively short length, i.e. typically less than 2 meters long. For a given spray height (the distance from the atomising zone to the deposition surface) the length of the deposit formed will be a function of the amplitude of oscillation of the spray. The discrete deposit may be a tube, ring, cone or any other axi-symmetric shape. For example, in the formation of a tubular deposit the spray is oscillated relative to a rotating tubular shaped collector so that by rapidly oscillating the spray along the longitudinal axis of the collector being the axis of rotation, a deposit is built up whose microstructure and properties are substantially uniform. The reason for this is that a spray, because of its low inertia, can be oscillated very rapidly (typically in excess of 10 cycles per second i.e. at least 10–100 times greater than the practical limit for reciprocating the collector) and consequently reciprocation lines which are formed in the reciprocation technique using a fixed spray are effectively eliminated or markedly reduced using this new method.

By controlling the rate and amplitude of oscillation and the instantaneous speed of movement of the spray throughout each oscillation cycle it is possible to form the deposit under whatever conditions are required to ensure uniform deposition conditions and therefore a uniform microstructure and a controlled shape. A simple deposition profile is shown in FIG. 2(*a*) but this can be varied to suit the alloy and the product. In FIG. 2(*a*) most of the metal has been deposited at the same rate of deposition.

The invention can also be applied to the production of spray-coated tube or bar for either single pass or discrete length production. In this case the substrate (a bar or tube) is not removed after the deposition operation but remains part of the final product. It should be noted that the bar need not necessarily be cylindrical in section and could for example be square, rectangular, or oval etc.

The invention will now be further described by way of example with reference to the accompanying diagrammatic drawings in FIGS. 3–9.

Figure 3:
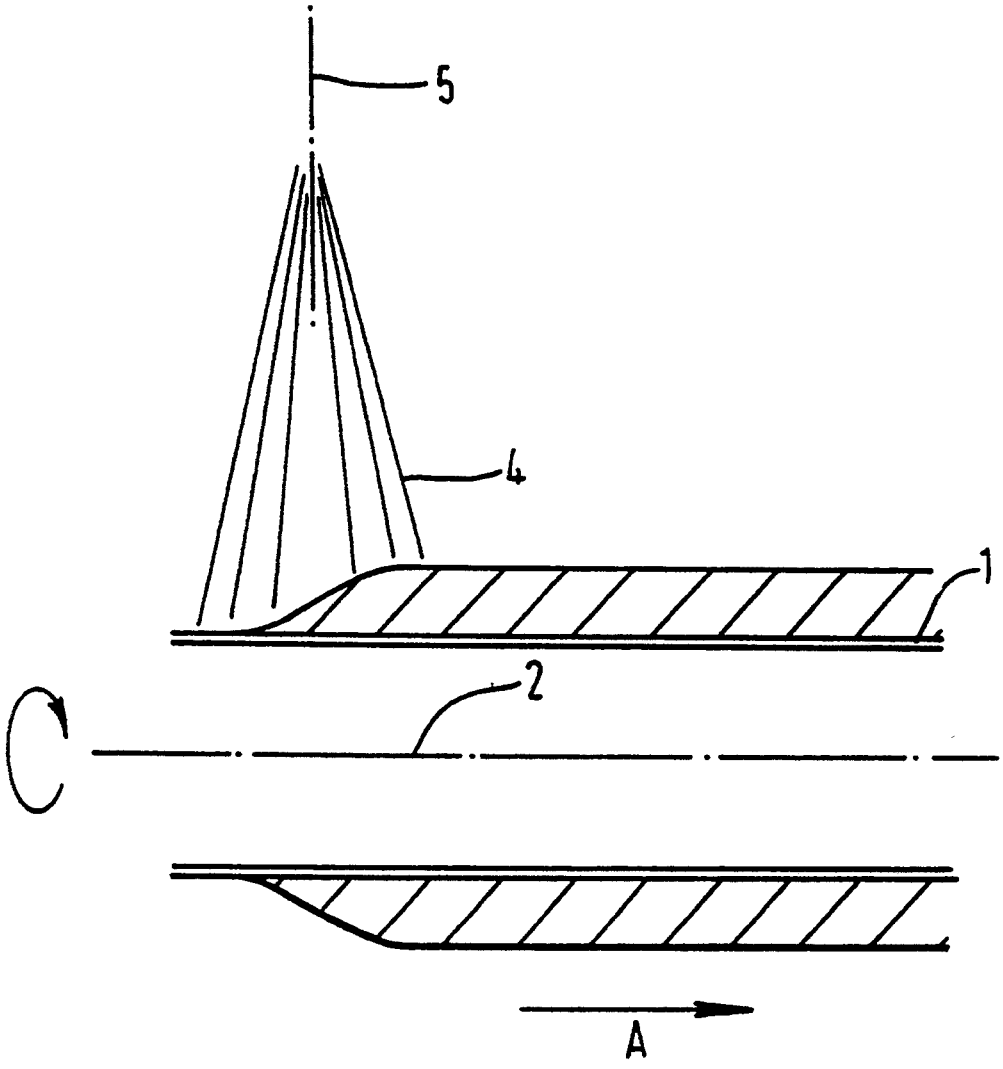
FIG. 3 illustrates the continuous formulation of a tubular deposit in accordance with the present invention.

In the apparatus shown in FIG. 3 a collector 1 is rotated about an axis of rotation 2 and is withdrawn in a direction indicated by arrow A beneath a gas atomised spray 4 of molten metal or metal alloy. The spray 4 is oscilliated to either side of a mean spray axis 5 in the direction of the axis of rotation of the substrate 1—which in fact coincides with the direction of withdrawal.

Figure 4:
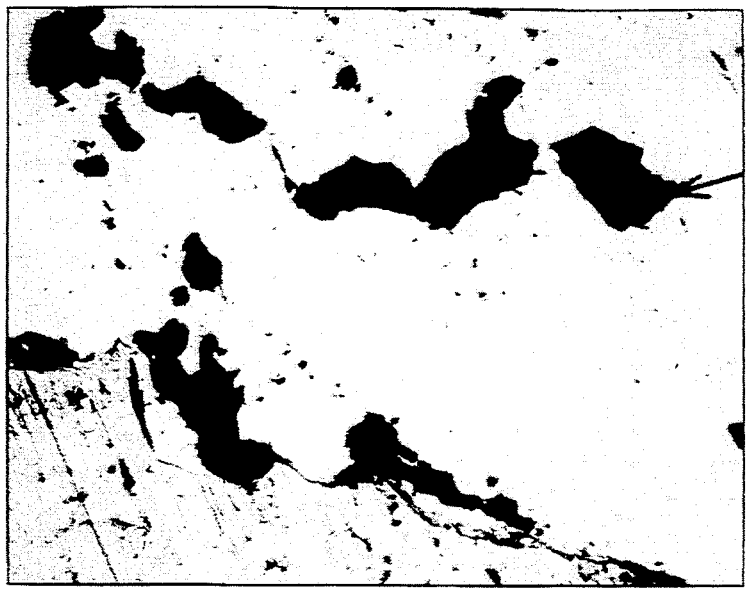
FIG. 4. PRIOR ART
FIG. 4 is a photomicrograph of the microstructure of a nickel-based superalloy IN625 spray deposited in conventional manner with a fixed (prior art) spray onto a mild steel collector.
Figure 5:
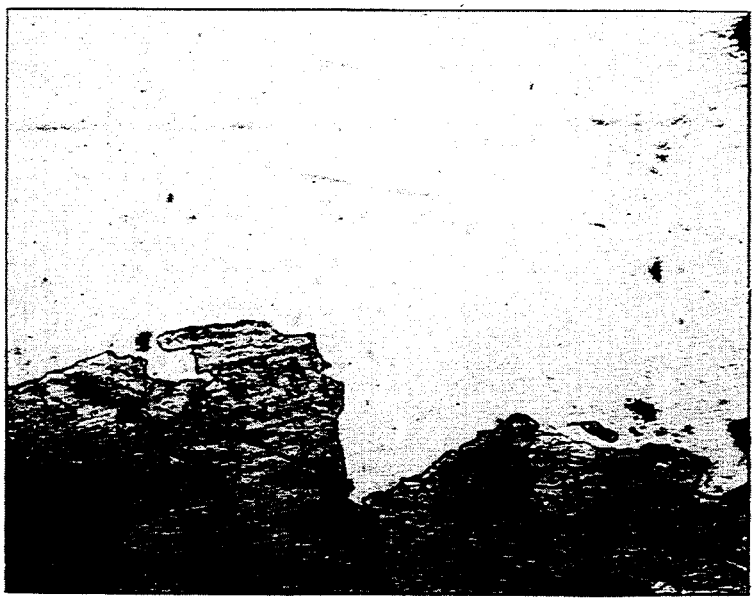
FIG. 5 is a photomicrograph of the microstructure of IN625 spray deposited by a single pass oscillating spray technique in accordance with the invention onto a mild steel collector.

FIGS. 4 and 5 contrast the microstructures of an IN625 deposit formed on a mild steel collector in the conventional manner (FIG. 4) and in accordance with the invention (FIG. 5) on a single continuous pass under an oscillating spray. The darker portion at the bottom of each photomicrograph is the mild steel collector, and the lighter portion towards the top of each photomicrograph is the spray deposited IN625. In FIG. 4 there are substantial areas in the spray deposited IN625 which are black and which are areas of porosity. In FIG. 5 using the oscillation spray technique of the invention the porosity is substantially eliminated.

Figure 6:
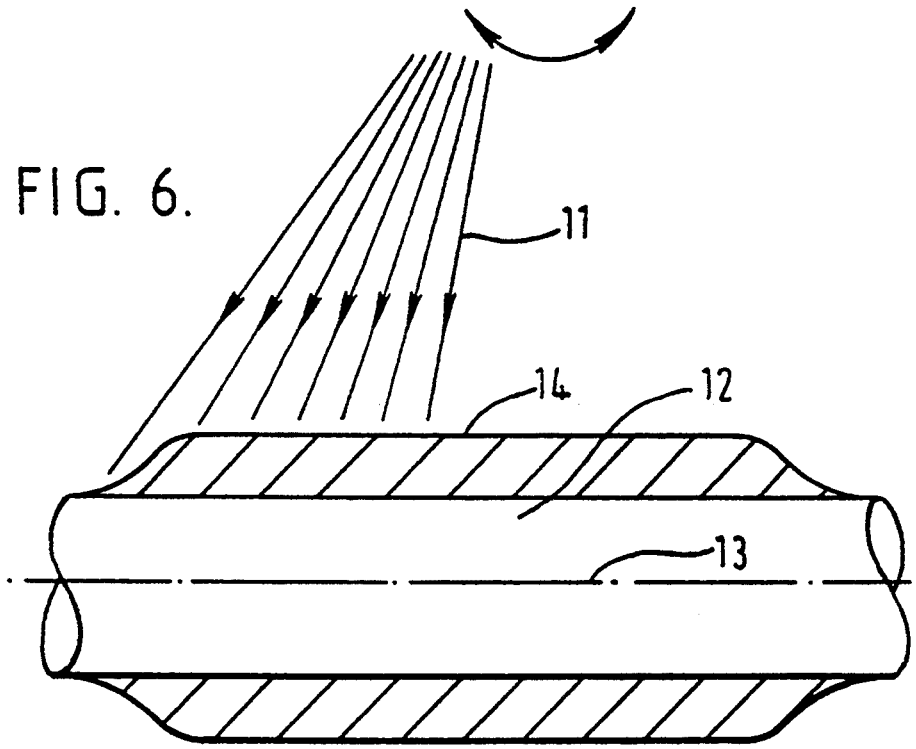
FIG. 6 illustrates diagrammatically the formation of a discrete tubular deposit.

In FIG. 6 a spray of atomised metal or metal alloy droplets 11 is directed onto a collector 12 which is rotatable about an axis of rotation 13. The spray deposit 14 builds up on the collector 12 and uniformity is achieved by oscillating the spray 11 in the direction of the axis of rotation 13. The speed of oscillation should be sufficiently rapid and the heat extraction controlled so that a thin layer of semi-solid/semi-liquid metal is maintained at the surface of the deposit over its complete length. For example, the oscillation is typically 5 to 30 cycles per second.

Figure 7:
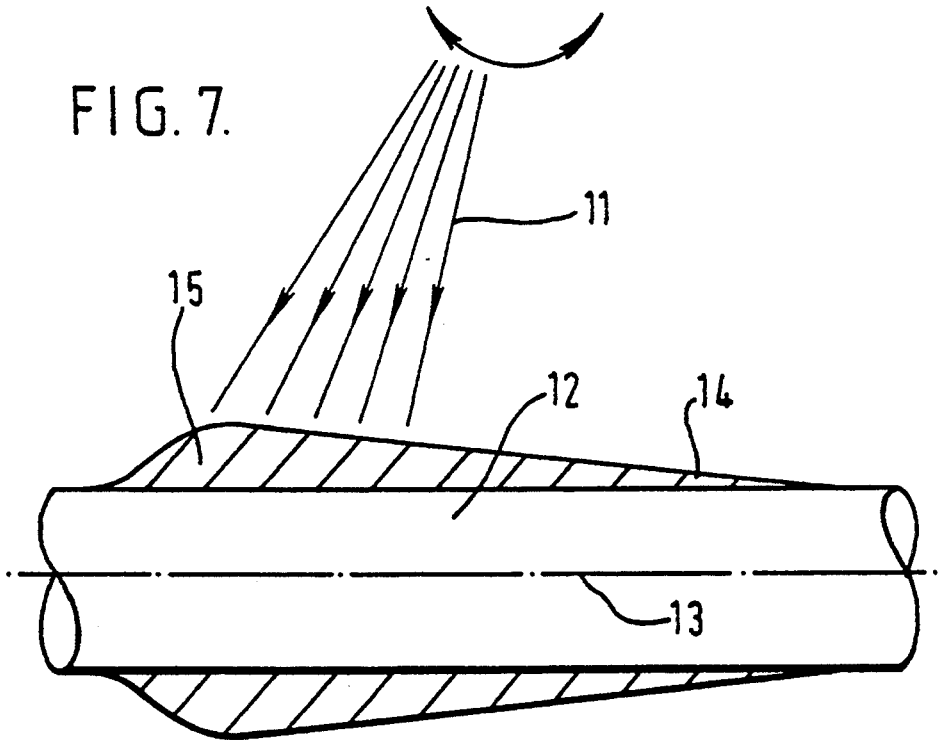
FIG. 7 illustrates the formation of a discrete tubular deposit of substantially frustoconical shape.

As seen from FIG. 7 the shape of the deposit may be altered by varying the speed of movement of the spray within each cycle of oscillation. Accordingly, where the deposit is thicker at 15 the speed of movement of the spray at that point may be slowed so that more metal is deposited as opposed to the thinner end where the speed of movement is increased. In a similar manner shapes can also be generated by spraying onto a collector surface that itself is conical in shape. More complicated shapes can also be generated by careful control of the oscillating amplitude and instantaneous speed of movement within each cycle of oscillation. It is also possible to vary the gas to metal ratio during each cycle of oscillation in order to accurately control the cooling conditions of the atomised particles deposited on different part of the collector. Furthermore the axis of rotation of the substrate need not necessarily be at right angles to the mean axis of the oscillating spray and can be tilted relative to the spray.

Figure 8:
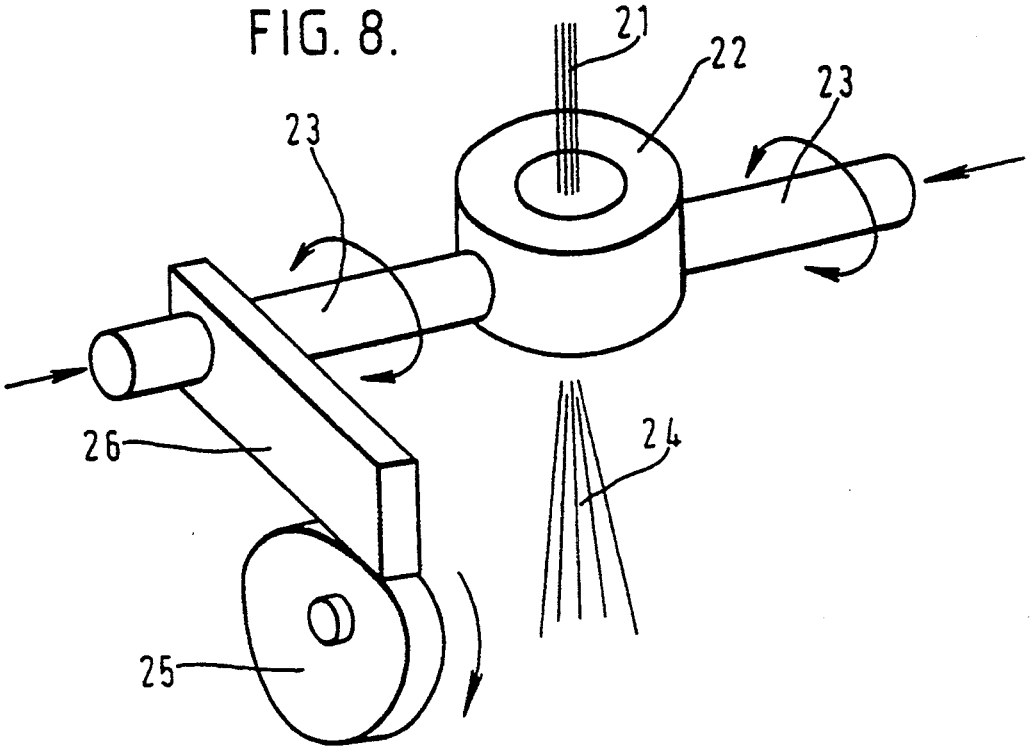
FIG. 8. illustrates diagrammatically a method for oscillating the spray.

In one method of the invention the oscillation of the spray is suitably achieved by the use of apparatus disclosed diagrammatically in FIG. 8. In FIG. 8 a liquid stream 21 of molten metal or metal alloy is teemed through an atomising device 22. The device 22 is generally annular in shape and is supported by diametrically projecting supports 23. The supports 23 also serve to supply atomising gas to the atomising device in order to atomise the stream 21 into a spray 24. In order to impart movement to the spray 24 the projecting supports 23 are mounted in bearings (not shown) so that the whole atomising device 22 is able to tilt about the axis defined by the projecting supports 23. The control of the tilting of the atomising device 22 comprises an eccentric cam 25 and a cam follower 26 connected to one of the supports 23. By altering the speed of rotation of the cam 25 the rate of oscillation of the atomising device 22 can be varied. In addition, by changing the surface profile of the cam 25, the speed of movement of the spray at any instant during the cycle of oscillation can be varied. In a preferred method of the invention the movement of the atomiser is controlled by electro-mechanical means such as a programme controlled stepper motor, or hydraulic means such as a programme controlled electro-hydraulic servo mechanism.

In the atomisation of metal it accordance with the invention the collector of the atomiser could be tilted. The important aspect of the invention is that the spray is moved over at least a part of the length of the collector so that the high density part of the spray is moved too and fro across the deposition surface. Preferably, the oscillation is such that the spray actually moves along the length of the collector, which (as shown) is preferably perpendicular to the spray at the centre of its cycle of oscillation. The spray need not oscillate about the central axis of the atomiser, this will depend upon the nature and shape of the deposit being formed.

The speed of rotation of the substrate and the rate of oscillation of the spray are important parameters and it is essential that they are selected so that the metal is deposited uniformly during each revolution of the collector. Knowing the mass flux density distribution of the spray transverse to the direction of oscillation it is possible to calculate the number of spray oscillation per revolution of the substrate which are required for uniformity.

Figure 9:
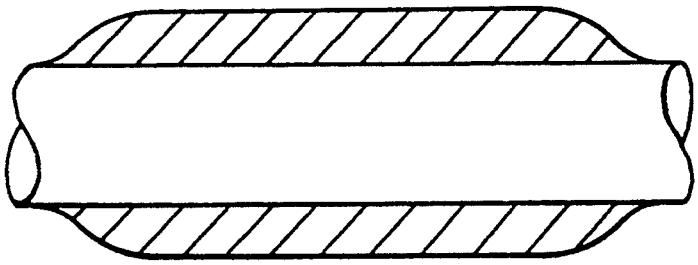
FIG. 9 is a diagrammatic view of the deposit formed in accordance with the example discussed later.

One example of a discrete length tubular product as shown in FIG. 9 is now disclosed by way of example:

| EXAMPLE OF DISCRETE LENGTH: TUBULAR PRODUCT | |
|---|---|
| DEPOSITED MATERIAL | 2.5%, Carbon, 4.3% Chromium, 6.3% Molybdenum, 7.3% Vanadium, 3.3% Tungsten, 0.75% Cobalt, 0.8% Silicon, 0.35% Manganese, Balance Iron plus trace elements |
| POURING TEMP. | 1450 degrees C. |
| METAL POURING NOZZLE | 4.8 mm diameter orifice |
| SPRAY HEIGHT | 480 mm (Distance from the underside of the atomiser to the top surface of the collector) |
| OSCILLATING ANGLE | +/− 9 degrees about a vertical axis |
| OSCILLATING SPEED | 12 cycles/sec |
| ATOMIZING GAS | Nitrogen at ambient temperature |
| COLLECTOR | 70 mm outside diameter by 1 mm wall thickness stainless steel tube (at ambient temperature) |
| COLLECTOR ROTATION | 95 r.p.m. |
| LIQUID METAL FLOW RATE INTO ATOMISER | 18 kg/min |
| GAS/METAL RATIO | 0.5–0.7 kg/kg |

Note that this was deliberately varied throughout the deposition cycle to compensate for excessive cooling by the cold collector of the first metal to be deposited and to maintain uniform deposition conditions as the deposit increases in thickness.

-continued

| EXAMPLE OF DISCRETE LENGTH: TUBULAR PRODUCT | |
|---|---|
| DEPOSIT SIZE (as shown in FIG. 9) | 90 mm ID 170 mm OD 110 mm long |

The average density of the deposit in the above example was 99.8% with essentially a uniform microstructure and uniform distribution of porosity throughout the thickness of the deposit. A similar tube made under the same conditions except that the collector was oscillated under a fixed spray at a rate of 1 cycle per 2 second, showed an average density of 98.7%. In addition, the porosity was mainly present of the reciprocating lines and not uniformly distributed. The grain structure and size of carbide precipitates were also variable being considerably finer in the reciprocation zones. This was not the case with the above example where the microstructure was uniform throughout.

There is now disclosed a second example of a deposit made by the single pass technique and with reference to FIGS. 4 and 5 discussed above:

| EXAMPLE OF DEPOSIT MADE BY THE SINGLE PASS TECHNIQUE | FIXED SPRAY | OSCILLATING SPRAY |
|---|---|---|
| DEPOSITED MATERIAL | IN625 | IN625 |
| POURING TEMPERATURE | 1450° C. | 1450° C. |
| METAL POURING NOZZLE (ORIFICE DIAMETER) | 6.8 mm | 7.6 mm |
| SPRAY HEIGHT | 380 mm | 380 mm |
| OSCILLATING ANGLE | 0 | 3° about vertical axis |
| OSCILLATING SPEED | 0 | 25 cycles per second |
| ATOMISING GAS | Nitrogen | Nitrogen |
| COLLECTOR | 80 mm diameter stainless steel by 1 mm wall thickness | |
| COLLECTOR ROTATION | 3 r.p.s. | 3 r.p.s. |
| TRAVERSE SPEED OF COLLECTOR | 0.39 m/min | 0.51 m/min |
| LIQUID METAL FLOW RATE INTO ATOMISER | 32 kg/min | 42 kg/min |
| GAS/METAL RATIO | 0.5 kg/kg | 0.38 kg/kg |
| SIZE OF DEPOSIT | 80 mm ID by 130 mm OD | |
| POROSITY | See FIG. 4 | See FIG. 5 |

It will be noted from FIG. 5 that there is reduced porosity for the Oscillating Spray. Also a higher flow rate of metal and a lower gas/metal ratio has been achieved.

In the method of the invention it is essential that, on average, a controlled amount of heat is extracted from the atomised particles in flight and on deposition including the superheat and a significant proportion of the latent heat.

The heat extraction from the atomised droplets before and after deposition occurs in 3 main stages:

(i) in-flight cooling mainly by convective heat transfer to the atomising gas. Cooling will typically be in the range 10-3–10-6 deg C./sec depending mainly on the size of the atomised particles. (Typically atomised particles sizes are in the size range 1–500 microns);

(ii) on deposition, cooling both by convection to the atomising gas as it flows over the surface of the spray deposit and also by conduction to the already deposited metal; and (iii) after deposition cooling by conduction to the already deposited metal.

It is essential to carefully control the heat extraction in each of the three above stages. It is also important to ensure that the surface of the already deposited metal consists of a layer of semi-solid/semi-liquid metal into which newly arriving atomised particles are deposited. This is achieved by extracting heat from the atomised particles by supplying gas to the atomising device under carefully controlled conditions of flow, pressure, temperature and gas to metal mass ratio and also by controlling the further extraction of heat after deposition. By using this technique deposits can be produced which have a non-particulate microstructure (i.e. the boundaries of atomised particles do not show in the microstructure) and which are free from macro-segregation.

If desired the rate of the conduction of heat on and after deposition may be increased by applying cold injected particles as disclosed in our European Patent published under No: 0198613.

As indicated above the invention is not only applicable to the formation of new products on a substrate but the invention may be used to form coated products. In such a case it is preferable that a substrate, which is to be coated is preheated in order to promote a metallurgical bond at the substrate/deposit interface. Moreover, when forming discrete deposits, the invention has the advantage that the atomising conditions can be varied to give substantially uniform deposition conditions as the deposit increases in thickness. For example, any cooling of the first metal particles to be deposited on the collector can be reduced by depositing the initial particles with a low gas to metal mass ratio. Subsequent particles are deposited with an increased gas to metal mass ratio to maintain constant deposition conditions and therefor, uniform solidification conditions with uniform microstructure throughout the thickness of the deposit.

It will be understood that, whilst the invention has been described with reference to metal and metal alloy deposition, metal matrix composites can also be produced by incorporating metallic and/or non-metallic particles and/or fibers into the atomised spray. In the discrete method of production it is also possible to produce graded microstructures by varying the amount of particles and/or fibers injected throughout the deposition cycle. The alloy composition can also be varied throughout the deposition cycle to produce a graded microstructure. This is particularly useful for products where different properties are required on the outer surface of the deposit compared to the interior (e.g. an abrasion resistant outer layer with a ductile main body). In addition, the invention can also be applied to the spray-deposition of non-metals, e.g. molten ceramics or refractory materials.

We claim:

1. In a method of forming a deposit on a surface of a substrate comprising the steps of:

teeming a stream of molten metal, metal alloy or molten ceramic through an atomizing device;

applying atomizing gas at said atomizing device for forming an atomizing gas flow field of a geometry which atomizes the stream into a spray of gas atomized molten metal, metal alloy or molten ceramic particles, said spray having a mean axis directed at the substrate;

rotating the substrate about an axis of the substrate, and extracting heat in flight and/or on deposition from the atomized particles to produce a coherent deposit;

imparting an oscillation to the gas flow field and thereby to the spray in the direction of the axis of the substrate such that an angle of the mean axis of the spray to the substrate and to the molten stream is varied, while the geometry of the atomizing gas flow field may remain substantially constant;

oscillating the gas flow field at a speed of oscillation in excess of five cycles per second such that a layer of semi-solid/semi-liquid metal, metal alloy or ceramic is substantially maintained at a deposition surface of the deposit over an amplitude of oscillation to maintain a substantially uniform microstructure through the deposit; and varying a ratio of atomizing gas to molten metal, metal alloy or molten ceramic during deposition to give substantially uniform deposition conditions as the deposit increases in thickness, whereby a tubular billet deposit of discrete, semi-continuous or continuous length may be formed about the substrate.

2. A method according to claim 1, wherein the substrate is additionally moved in its axial direction relative to the spray, whereby a deposit of semi-continuous or continuous length may be formed.

3. A method according to claim 1, wherein the axis of the substrate is substantially perpendicular to the direction of the spray during a part of its oscillation.

4. A method according to claim 1, wherein the spray is moved at a speed which is varied during each cycle of oscillation.

5. A method according to claim 1, wherein the deposit formed is a tubular body generated about the axis of rotation.

6. A method according to claim 1, wherein a variable amount of heat is extracted in flight during the formation of the deposit to maintain said layer, and less heat is extracted in flight on initial deposition to reduce porosity.

7. A method according to claim 1, wherein metallic or non-metallic particles and/or fibers are introduced into the atomized spray to form a composite deposit.

8. A method of forming a deposit on a surface of an elongate substrate comprising the steps of:

teeming a stream of molten metal, metal alloy or molten ceramic through an atomizing device;

forming an atomizing gas flow field of a cooler atomizing gas;

generating a spray of gas atomized molten metal, metal alloy or ceramic particles which are directed at the substrate by the application to the stream of the cooler atomizing gas flow field, the substrate being positioned with its longitudinal axis transverse to the spray and said spray having a mean axis directed at the substrate;

rotating the substrate about its longitudinal axis;

oscillating the spray over an amplitude of oscillation so that the spray is moved over at least a part of the surface of the substrate, said oscillating comprising varying an angle of the mean axis of the spray to the substrate and to the molten stream while geometry of the atomizing gas flow field may remain substantially constant;

extracting a controlled amount of heat in flight and on deposition from the atomized particles by the relatively cold atomizing gas, and oscillating the spray at a speed of oscillation in excess of five cycles per second, to produce and maintain a layer of semi-solid/semi-liquid metal, metal alloy or ceramic at a deposition surface of the deposit over an amplitude of the oscillation throughout the deposition operation to produce a deposit which has a non-particulate microstructure and is free from macro-segregation; and varying a ratio of atomizing gas to molten metal, metal alloy or molten ceramic during deposition to give substantially uniform deposition conditions as the deposit increases in thickness, whereby a tubular billet deposit of discrete, semi-continuous or continuous length may be formed about the substrate.

9. In a method of forming a deposit on a surface of a substrate comprising the steps of:

generating a spray of gas atomized molten metal, metal alloy or molten ceramic particles by means of an atomizing device forming an atomizing gas flow field, said spray having a mean axis directed at the substrate;

rotating the substrate about an axis of the substrate;

extracting heat in flight and/or on deposition from the atomized particles to produce a coherent deposit;

the improvement comprising;

supporting the atomizing device for movement, effecting movement of the atomizing device at a speed of movement, whereby:

the spray is oscillated in the direction of the axis over an amplitude of oscillation, an angle of the mean axis of the spray to the substrate is varied, and geometry of the atomizing gas flow field may remain substantially constant;

controlling the speed of movement of the atomizing device, whereby the oscillation of the spray is in excess of five cycles per second to maintain a layer of semi-solid/semi-liquid metal or ceramic at a deposition surface of the deposit over the amplitude of oscillation; and varying a ratio of atomizing gas to molten metal, metal alloy or molten ceramic during deposition to give substantially uniform deposition conditions as the deposit increases in thickness, whereby a tubular billet deposit of discrete, semi-continuous or continuous length may be formed about the substrate.

10. A method according to claim 1, comprising controlling the rate and amplitude of the oscillation of the spray to favorably influence the angle of impingement of the atomized particles on the forming deposit.

11. A method according to claim 9, wherein the movement of the atomizing device comprises tilting of the whole atomizing device.

12. In a method of forming a deposit on a surface of a substrate comprising the steps of:

teeming a stream of molten metal, metal alloy or molten ceramic through an atomizing device;

generating a spray of gas atomized molten metal, metal alloy or molten ceramic particles by the application to the stream of an atomizing gas flow field at a temperature less than that of the said molten metal, metal alloy or molten ceramic, and said spray having a mean axis directed at the substrate, and extracting heat in flight and/or on deposition from the atomized particles by said cooler atomizing gas to produce a coherent deposit the improvement comprising oscillating the spray over an amplitude of oscillation at a speed of oscillation in excess of five cycles per second whereby;

(a) an angle of the mean axis of the spray to the substrate and to the molten stream is varied;

(b) geometry of the atomizing gas flow field may remain substantially constant;

(c) a deposition profile of the spray is modified by elongation across the surface of the substrate or a deposition surface of the deposit forming thereon;

(d) a layer of semi-solid/semi liquid metal or ceramic is maintained at a deposition surface of the deposit over the amplitude of oscillation; and, a ratio of atomizing gas to molten metal, metal alloy or molten ceramic is varied during deposition to give substantially uniform deposition conditions as the deposit increased in thickness, whereby a tubular billet deposit of discrete semi-continuous or continuous length may be formed about the substrate.

13. A method of forming a deposit according to claim 12, wherein the oscillation of the spray is effected by movement of the atomizing device.

* * * * *